US008430674B2

(12) United States Patent
Pichard et al.

(10) Patent No.: US 8,430,674 B2
(45) Date of Patent: Apr. 30, 2013

(54) CONNECTOR WITH A BLADE, TOOL FOR ACTUATING SAID CONNECTOR, KIT AND FIRE DETECTOR COMPRISING SAME

(75) Inventors: Laurent Pichard, Nanterre (FR); Stéphane Di Marco, Nanterre (FR); Christophe Bonazzi, Nanterre (FR)

(73) Assignee: Finsecur, Nanterre (FR)

( * ) Notice: Subject to any disclaimer, the term of this patent is extended or adjusted under 35 U.S.C. 154(b) by 0 days.

(21) Appl. No.: 13/322,478

(22) PCT Filed: May 25, 2010

(86) PCT No.: PCT/FR2010/000382

§ 371 (c)(1),
(2), (4) Date: Nov. 25, 2011

(87) PCT Pub. No.: WO2010/136666

PCT Pub. Date: Dec. 2, 2010

(65) Prior Publication Data

US 2012/0071018 A1 Mar. 22, 2012

(30) Foreign Application Priority Data

May 26, 2009 (FR) ..... 09 02527

(51) Int. Cl.
*H01R 11/20* (2006.01)

(52) U.S. Cl.
USPC ..... 439/44

(58) Field of Classification Search ..... 439/436–441, 439/431–433
See application file for complete search history.

(56) References Cited

U.S. PATENT DOCUMENTS

| | | | | |
|---|---|---|---|---|
| 6,146,187 | A * | 11/2000 | Pallai | 439/441 |
| 6,250,950 | B1 * | 6/2001 | Pallai | 439/441 |
| 6,315,597 | B1 | 11/2001 | Coyne et al. | |
| 7,354,319 | B2 * | 4/2008 | Camino et al. | 439/828 |
| 7,651,363 | B2 * | 1/2010 | Koellmann | 439/441 |
| 2005/0042912 | A1 * | 2/2005 | Drewes et al. | 439/441 |
| 2006/0063419 | A1 * | 3/2006 | Steinkemper et al. | 439/441 |
| 2006/0063420 | A1 * | 3/2006 | Reibke et al. | 439/441 |
| 2006/0128206 | A1 * | 6/2006 | Oesterhaus | 439/441 |

FOREIGN PATENT DOCUMENTS

| | | | |
|---|---|---|---|
| DE | 102005058307 | A1 | 6/2007 |
| JP | 11219736 | A | 8/1999 |
| WO | WO 00/31830 | A1 | 6/2000 |

* cited by examiner

*Primary Examiner* — Ross Gushi
(74) *Attorney, Agent, or Firm* — IM IP Law PLLC; C. Andrew Im

(57) ABSTRACT

The present invention relates to a connector with a blade comprising a housing. The housing comprises a lateral opening designed to receive an electric wire, a flexible blade and an opening opposite a free part of the blade. The flexible blade is designed to make contact with the electric wire and to retain the wire by applying pressure on it towards a wall of the housing. The opening has a shape designed to guide the head of a tool and make the head of the tool follow a helical motion. The opening may be threaded and cylindrical and the opening's thread may comprise only one helical groove formed in the wall of the opening.

14 Claims, 4 Drawing Sheets

CONNECTOR WITH A BLADE, TOOL FOR ACTUATING SAID CONNECTOR, KIT AND FIRE DETECTOR COMPRISING SAME

RELATED APPLICATIONS

This application is a §371 application from PCT/FR2010/000382 filed May 25, 2010, which claims priority from French Patent Application No. 09 02527 filed May 6, 2009, each of which is herein incorporated by reference in its entirety.

TECHNICAL FIELD OF THE INVENTION

The present invention relates to a connector with a blade, a tool for actuating said connector, a kit and a fire detector comprising same. It is applicable to any connector with a blade, for mounting on a circuit board or in an electrical circuit and, more specifically, to contactors for fire detectors.

BACKGROUND OF THE INVENTION

Blade contactors that comprise a metal blade generally curved in a horizontal U-shape within a housing are known. The lower branch of this blade is fixed to the housing floor, while the upper branch rests on the housing ceiling. The blade thus forms a spring whose upper extremity is free. A lateral opening allows the introduction of a bare electric wire that presses on the upper branch of the blade, deforms it and enters between this blade and the housing ceiling. Once in place, because of the blade's shape, the wire can only be released by pressing on the blade with a tool. This pressing is generally performed through an opening in the connector ceiling. The electrical contact formed between the electric wire and the blade is thus very stable and easy to implement.

However, there are cases where access to the connector is difficult, for example when it is incorporated in a housing, e.g. a fire detector housing, mounted on a ceiling. In addition, if the housing is mounted on a suspended ceiling tile or other flexible mounting, pressing the blade moves the mounting away, which can deform it or cause it to fall. In addition, pressing in this way does not allow the release of the electric wire.

OBJECT AND SUMMARY OF THE INVENTION

The aim of the present invention is to remedy these drawbacks. In particular, this invention aims to allow an electric wire inserted between the blade and the housing ceiling to be released using one hand, even when the housing mounting is flexible, deformable or fragile.

To this end, this invention envisages, according to a first aspect, a connector with a blade comprising a housing that comprises:

- a lateral opening designed to receive an electric wire,
- a flexible blade designed to make electrical contact with said electric wire and to retain said electric wire by applying pressure on it towards a wall of said housing and
- an opening opposite a free part of said blade, said opening having a shape designed to guide the head of a tool and make it follow a helical motion.

Thanks to these provisions, using a tool fitted with a head shaped or threaded to match the connector opening opposite the free part of the blade, the user, holding the tool in one hand, can cause the head of the tool to enter this opening and, after rotating the tool, pressure to be applied on the blade, which has the effect of releasing the electric wire. In addition, it is not necessary to apply pressure on the connector when rotating the tool and, consequently on its mounting, which prevents distortion, deterioration or displacement of this mounting. The connector that is the subject of the present invention also has the advantage that, if the specific tool to release the electric wire without applying any force on the mounting is not available, a tip can be used through the threaded opening to apply pressure on the blade and release the electric wire.

According to particular features, said opening is threaded.

According to particular features, said threaded opening is cylindrical and the thread of said opening comprises a helical groove formed on the wall of said opening.

According to particular features, said threaded opening is cylindrical and the thread of said opening comprises a lateral projection formed on the wall of said opening.

Thanks to each of these provisions, the threading is strong and can withstand handling errors. In addition, this threading means that less than one turn is required to cause the electric wire to be released.

According to a second aspect, this invention envisages a tool to release an electric wire in a connector that is the subject of the present invention, said tool comprising a head designed to enter the opening of said connector, said head having a shape designed to follow the shape of the opening in a helical motion of the tool in relation to the connector.

According to particular features, the head comprises threading that matches the threading of the connector opening.

According to particular features, the head comprises a lateral projection that corresponds with the helical groove of the connector opening.

According to particular features, the head comprises a helical groove that matches the lateral projection of the connector opening.

According to a third aspect, this invention envisages a kit comprising at least one connector and a tool, which are the subjects of the present invention.

According to particular features, the shape of the tool head and the opening exhibit a geometry designed such that the travel of said tool in rotation about its axis is less than one half-turn before the extremity of the tool applies pressure on the free part of the blade.

Because of these provisions, a motion of less than one half-turn is sufficient to cause the release of the electric wire, which allows a release in a single movement.

According to particular features, the shape of the tool head and the opening exhibit a geometry designed such that the travel of said tool in rotation about its axis is approximately one quarter-turn before the extremity of the tool applies pressure on the free part of the blade.

Because of these provisions, a motion of less than one quarter-turn is sufficient to cause the release of the electric wire, which allows a release in a single movement.

According to a fourth aspect, this invention envisages a fire detector comprising a sensor whose physical size is representative of a fire and a connector that is the subject of the present invention.

According to a fifth aspect the present invention envisages a method to connect an electric wire to a connector with a blade that comprises:

- a step of forming a housing comprising:
  - a lateral opening designed to receive an electric wire, a flexible blade designed to make electrical contact with said electric wire and to retain said electric wire by applying pressure on it towards a wall of said housing and an opening opposite a free part of said blade, said opening having a shape designed to guide the head of a tool and make it follow a helical motion;

to connect the electric wire, a step of inserting the electric wire into said lateral opening and to release said electric wire, a step of inserting a head of a tool in said opening and of moving said tool in a helical motion.

As the particular characteristics, advantages and aims of this tool, of this kit, of this detector and of this method are similar to those of the connector that is the subject of the present invention, as described in brief above, they are not repeated here.

BRIEF DESCRIPTION OF THE DRAWINGS

Other advantages, aims and characteristics of the present invention will become apparent from the description that will follow, made, as an example that is in no way limiting, with reference to the drawings included in an appendix, in which.

DETAILED DESCRIPTION OF THE EMBODIMENTS

Figure 1:
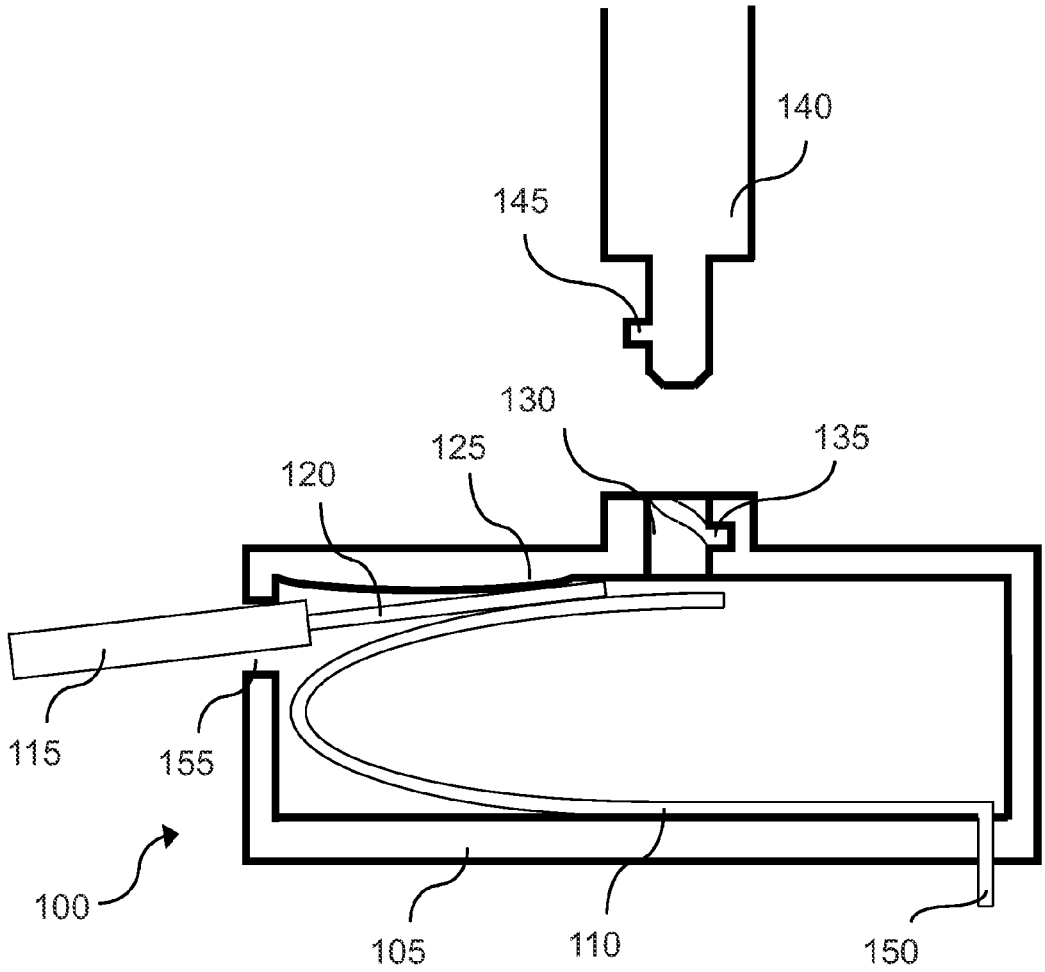
FIG. 1 represents, schematically and in cross-section, a particular embodiment of the connector that is the subject of the present invention, before an electric wire inserted into said connector is released.

FIG. 1 shows a connector 100 that comprises a housing 105, a flexible conductive blade 110, part of which 150 protrudes from the housing 105, an electric wire 120 fitted with an insulating sheath 115 and a bearing area 125 of the housing 105.

In addition, the connector 100 has an upper opening 130 having a threading 135, in which the head of a tool 140, with a corresponding threading 145, can move.

The housing 105 is made of insulating material, e.g. rigid plastic. The flexible conductive blade 110 has sufficient flexibility to deform either under the lateral pressure of the electric wire 120, or under the vertical pressure of the tool 140. The part 150 of the conductive blade 110 that protrudes from the housing 105, at the lower surface of the housing, is used for the electrical connection on a printed circuit (not shown). When inserted through the lateral opening of the housing 105, the wire 120 is thus jammed between the bearing area 125 and the blade 110 of the housing 105. In a variant, this bearing area is replaced by a special shape of the extremity of the blade called "snake tongue"; the blade is split at its upper extremity into two triangular areas between which the electric wire 120 enters.

Within the meaning of the present invention, the term "thread" is used in its broadest sense. In effect, it covers any combination of matching shapes, between the tool head 140 and the opening 135 that allows the first to follow a helical motion in the second, i.e. a combination of a rotation and a translation with the same axis.

Preferably, the travel of the tool 140 in rotation about its axis in the threading 135 of the opening 130 is less than one half-turn before the tool's extremity presses on the free part of the blade, which allows the release of the electric wire 120. Even more preferably, this travel is about a quarter turn, i.e. an angle of between 60 and 120 degrees.

Figure 2:
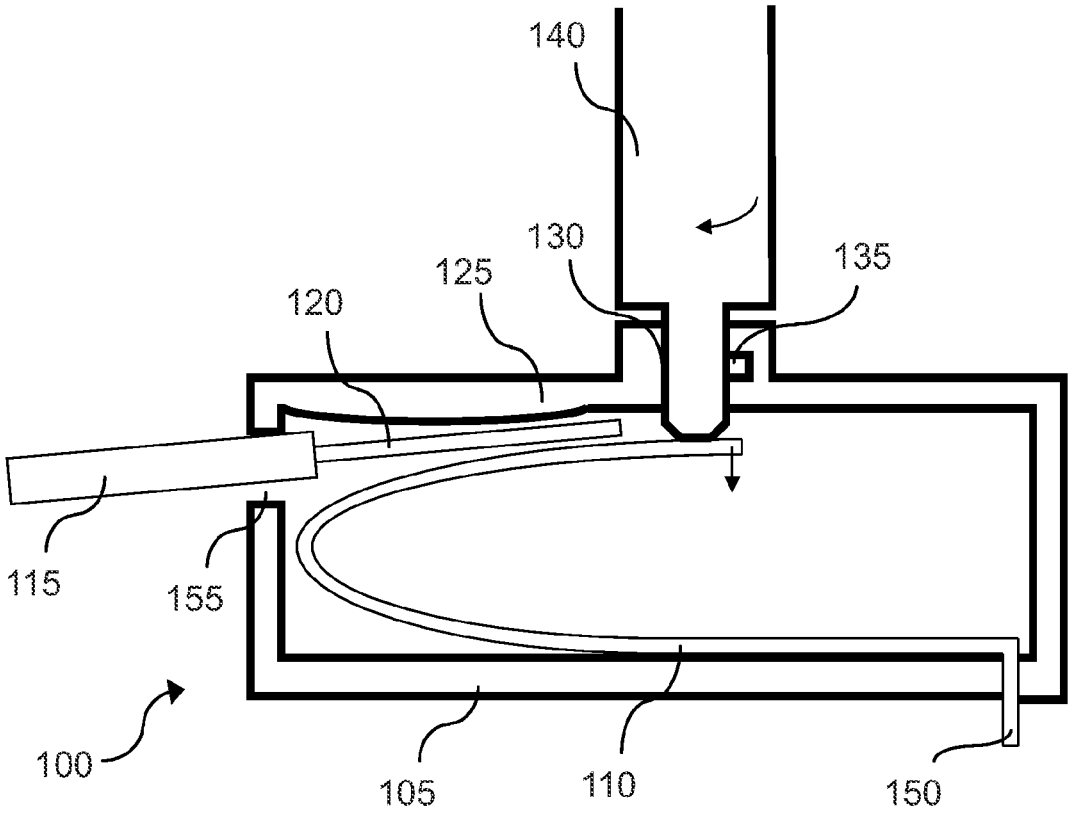
FIG. 2 represents, schematically and in cross-section, the connector shown in FIG. 1, during the release of the electric wire.

In the embodiment shown in FIGS. 1 and 2, the threaded opening 130 is cylindrical and the threading of said opening only comprises one helical groove 135 formed in the wall of said opening 130.

Matching this groove, the head of the tool 140 essentially presents a lateral projection 145 that follows the thread 135 during the rotation of the tool 140. During this rotation, the head of the tool 140 is thus driven in a helical motion and its extremity presses the upper extremity of the blade 110, which has the effect of pushing this blade 110 downwards and releasing the electric wire 120, as shown in FIG. 2.

In other embodiments, it is the opening 130 that has a projection that enters a groove in the head of the tool 140. In these embodiments, the opening and the head of the tool are always threaded.

In other embodiments, the opening 130 and the tool head 140 have matching threads, exiting, for the first, at each extremity of the opening 130 and reaching, for the second; the lower extremity of the tool head 140.

To ensure that a half-turn of the tool 140 is sufficient to release the wire 120, the pitch of the thread is at least twice the required vertical motion of the upper extremity of the blade 110.

To ensure that a quarter-turn of the tool 140 is sufficient to release the wire 120, the pitch of the thread is at least four times the required vertical motion of the upper extremity of the blade 110.

In the embodiment described in FIGS. 1 and 2, the head of the tool 140 has a non-threaded extremity whose length is greater than the distance between the upper wall of the housing 105 and the blade 110 when the electric wire 120 is released. Thus, the thread 145 is not likely to break free of the threading 135 in the housing 105.

Thus, by rotating the tool 140 held in one hand, the user can cause the tool head 140 to enter into the opening 130 of the housing 105 and the tool head to rotate, because of the threading 135 of the housing 105, and pressure to be applied on the blade 110, which has the effect of releasing the electric wire 120 in a single movement of the hand holding the tool 140.

Thanks to these provisions, it is not necessary to apply pressure on the housing 105 while rotating the tool 140. Accordingly, even if the housing (see FIG. 3) comprising the connector 100 is mounted on a fragile, flexible or removable mounting, disconnecting the wire 120 presents no risk of deteriorating, deforming, moving or dismantling this mounting.

The connector that is the subject of the present invention also has the advantage that, if the specific tool 140 to release the electric wire 120 without applying any force to the mounting is not available, a tip can be used through the threaded opening 130 to apply pressure on the blade 110 and release the electric wire 120.

Figure 5:
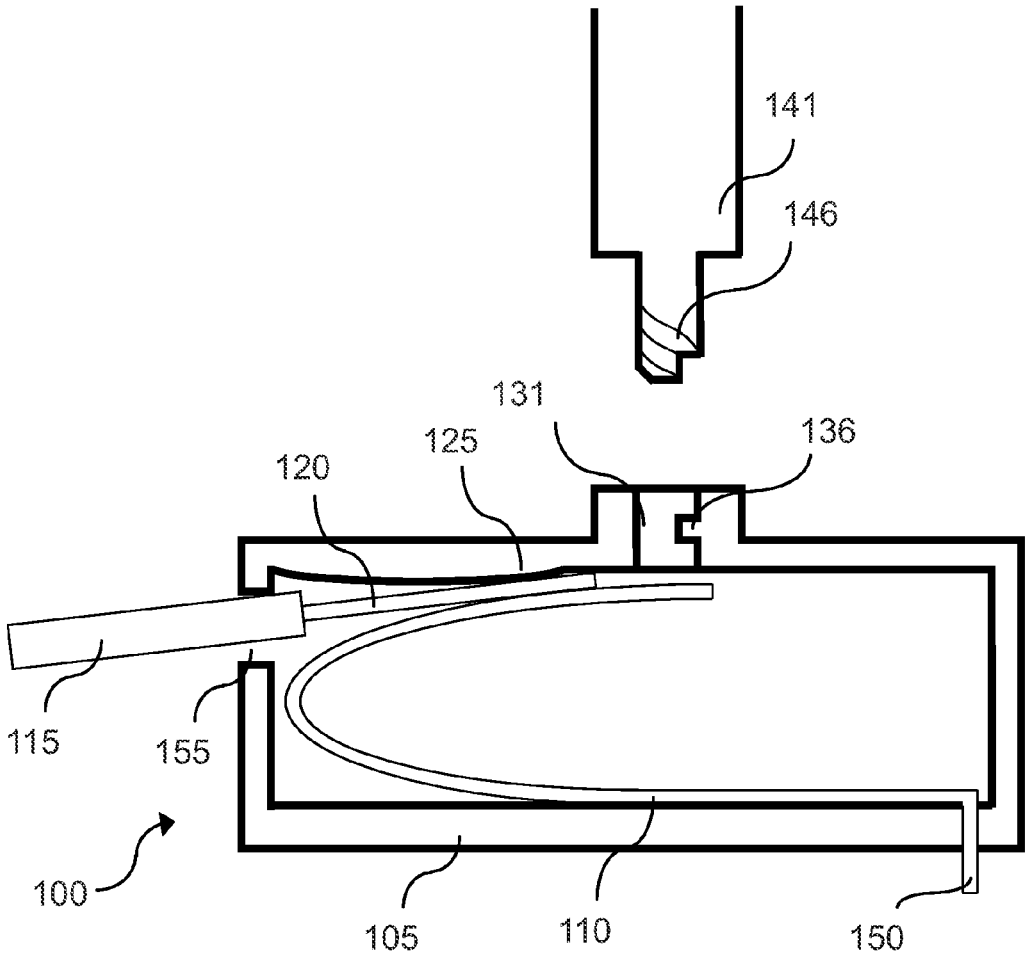
FIG. 5 represents, schematically and in cross-section, a variant of the embodiment shown in FIGS. 1 and 2.

In the variant shown in FIG. 5, the helical groove 135 is replaced by a lateral projection 136 and the lateral projection 145 is replaced by a helical groove 146.

Thus, within the meaning of this invention, the connector 100 has an upper opening 131 with a thread 136, in which the head of a tool 141, with a corresponding threading 146 can move.

The head of the tool 141 thus has a groove 146 in which the lateral projection 136 moves during the rotation of the tool 141. During this rotation, the head of the tool 141 is thus driven in a helical motion and its extremity presses on the upper end of the blade 110, which has the effect of pushing this blade 110 downwards and releasing the electric wire 120.

Figure 3:
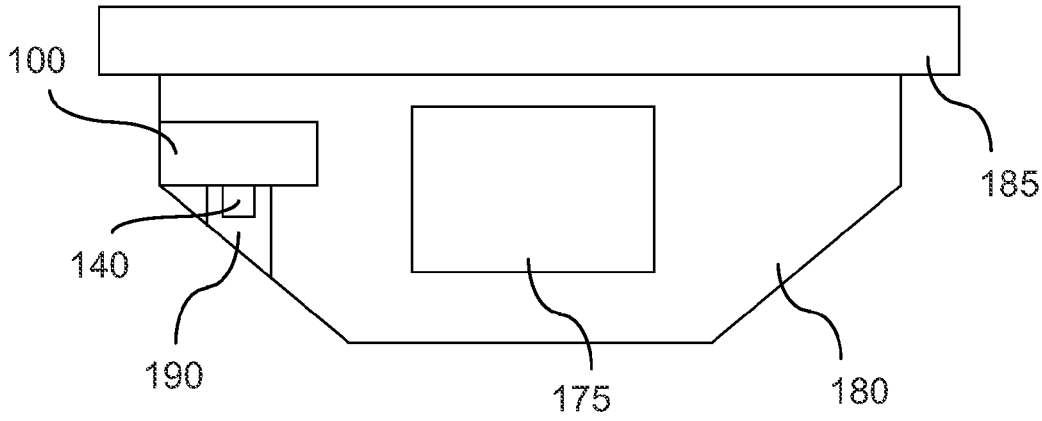
FIG. 3 represents, schematically and in cross-section, a fire detector that is the subject of the present invention.

In FIG. 3, a fire detector 180 mounted on a mounting 185 is shown, which comprises:

- a sensor 175 of a physical quantity representative of the occurrence of fire (e.g. heat, gas or smoke sensor) and
- a connector 100 (which is turned downwards in relation to its representation in FIGS. 1 and 2), and an opening 190 opposite the opening 130, that allows a tool to reach the opening 130.

Figure 4:
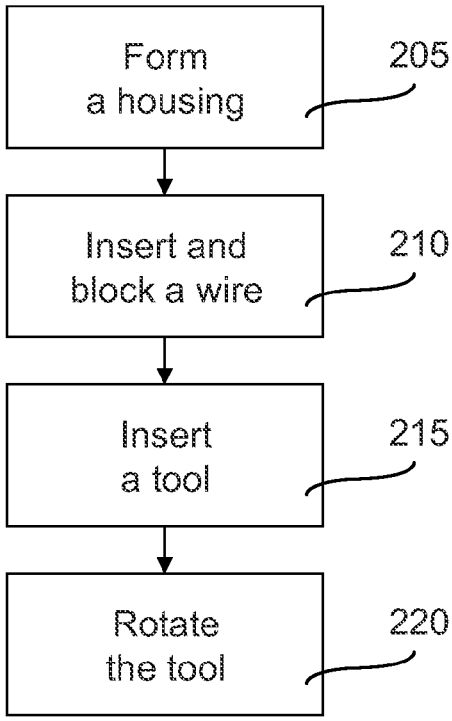
FIG. 4 represents in flowchart form, the steps of a particular manufacturing method of a connector, which method is the subject of the present invention

It can be seen in FIG. 4 that in one particular embodiment, the method of manufacturing a connector with a blade 100, which is the subject of the present invention, comprises:

- a step 205 of forming a housing comprising:
  - a lateral opening designed to receive an electric wire,
  - a flexible blade designed to make electrical contact with said electric wire and to retain said electric wire by applying pressure on it towards a wall of said housing and
  - an opening opposite a free part of said blade, said opening being at least partially threaded.
- to connect the electric wire, a step 210 of inserting the electric wire into said lateral opening and
- to release said electric wire, a step 215 of inserting a tool having, at least partially, a thread corresponding to the thread of said threaded opening and
- a step 220 of moving said tool in rotation.

While the claimed invention has been particularly described with respect to the illustrated embodiments, it will be appreciated that various alterations, modifications and adaptations may be made based on the present disclosure, and are intended to be within the scope of the claimed invention. It is intended that the appended claims be interpreted as including the embodiments discussed above, the various alternatives that have been described, and all equivalents thereto.

In the claims, the words "comprises" or "comprising" do not exclude other elements or steps, and the indefinite article "a" or "an" doe not exclude a plurality. The mere fact that different features are recited in mutually different claims does not indicate that a combination of these features cannot be advantageously used, such a combination remaining in the scope of the invention.

The invention claimed is:

1. Connector with a blade comprising a housing, wherein said housing comprises:

- a lateral opening designed to receive an electric wire;
- a flexible blade designed to make contact with said electric wire and to retain said wire by applying pressure on it towards a wall of said housing; and
- an opening opposite a free part of said blade, said opening having a shape designed to guide the head of a tool to make it follow a helical motion.

2. Connector according to claim 1, wherein said opening has a thread.

3. Connector according to claim 2, wherein said threaded opening is cylindrical and the thread of said opening comprises a helical groove formed in the wall of said opening.

4. Connector according to claim 1, wherein said threaded opening is cylindrical and the thread of said opening comprises a lateral projection formed on the wall of said opening.

5. Fire detector comprising a sensor of a physical size representative of a fire and a connector according to claim 1.

6. Tool to release an electric wire in a connector according to claim 1, said tool comprising a head designed to enter into the opening of said connector, said head having a shape designed to follow the shape of the opening in a helical motion of the tool in relation to the connector.

7. Tool according to claim 6, wherein said head comprises a thread that matches a thread of the opening of said connector.

8. Tool according to claim 6, wherein said head comprises a lateral projection that matches a helical groove of the opening of the connector.

9. Tool according to claim 6, wherein said head comprises a helical groove that matches a lateral projection of the opening of the connector.

10. Kit comprising:

- at least one connector with a blade comprising a housing, wherein said housing comprises:
  - a lateral opening designed to receive an electric wire;
  - a flexible blade designed to make contact with said electric wire and to retain said wire by applying pressure on it towards a wall of said housing; and
  - an opening opposite a free part of said blade, said opening having a shape designed to guide the head of a tool to make it follow a helical motion; and
- at least one tool to release an electric wire in one of said connector, said tool comprising a head designed to enter into the opening of said connector, said head having a shape designed to follow the shape of the opening in a helical motion of the tool in relation to the connector.

11. Kit according to claim 10, wherein the shape of the tool head and the opening exhibit a geometry designed such that the travel of said tool in rotation about its axis is less than one half-turn before the extremity of the tool applies pressure on the free part of the blade.

12. Kit according to claim 11, wherein the shape of the tool head and the opening exhibit a geometry designed such that the travel of said tool in rotation about its axis is substantially one quarter-turn before the extremity of the tool applies pressure on the free part of the blade.

13. Kit according to claim 10, wherein the shape of the tool head and the opening exhibit a geometry designed such that the travel of said tool in rotation about its axis is substantially one quarter-turn before the extremity of the tool applies pressure on the free part of the blade.

14. Method for connecting an electric wire to a connector with a blade, comprising the steps of:

- inserting the electric wire into a lateral opening of a housing comprising:
  - a flexible blade designed to make electrical contact with said electric wire and to retain said electric wire by applying pressure on it towards a wall of said housing; and
  - an opening opposite a free part of said blade, said opening having a shape designed to guide the head of a tool and make it follow a helical motion; and
- releasing said electric wire by inserting a head of a tool in said opening and moving said tool in a helical motion.

* * * * *